US006174448B1

(12) United States Patent
Das et al.

(10) Patent No.: US 6,174,448 B1
(45) Date of Patent: Jan. 16, 2001

(54) METHOD FOR STRIPPING ALUMINUM FROM A DIFFUSION COATING

(75) Inventors: Nripendra N. Das, West Chester; Howard J. Farr, Blue Ash; Raymond W. Heidorn, Fairfield, all of OH (US)

(73) Assignee: General Electric Company, Cincinnatu, OH (US)

( * ) Notice: Under 35 U.S.C. 154(b), the term of this patent shall be extended for 0 days.

(21) Appl. No.: 09/032,790

(22) Filed: Mar. 2, 1998

(51) Int. Cl.[7] ..... C23F 1/00; C23C 16/00; B08B 7/00

(52) U.S. Cl. ..... 216/2; 216/52; 216/53; 216/76; 134/6; 134/7; 427/252

(58) Field of Search ..... 134/2, 3, 6, 7; 216/2, 52, 56, 76; 427/252, 253

(56) References Cited

U.S. PATENT DOCUMENTS

| | | | | |
|---|---|---|---|---|
| 4,041,196 | * | 8/1977 | Baldi et al. | 427/252 |
| 4,327,134 | * | 4/1982 | Baldi | 427/253 |
| 4,889,589 | | 12/1989 | McComas | 216/76 |
| 5,167,721 | | 12/1992 | McComas et al. | 134/32 |
| 5,254,413 | | 10/1993 | Maricocchi | 428/633 |
| 5,614,054 | | 3/1997 | Reeves et al. | 156/344 |
| 5,728,227 | | 3/1998 | Reverman | 134/2 |
| 5,831,118 | | 9/1998 | Roedl et al. | 29/889.1 |
| 5,851,409 | * | 12/1998 | Schaeffer et al. | 216/2 |
| 5,900,102 | * | 5/1999 | Reeves | 156/344 |

* cited by examiner

*Primary Examiner*—Gregory Mills
*Assistant Examiner*—Alva C Powell
(74) *Attorney, Agent, or Firm*—Andrew C. Hess; Gerry S. Gressel

(57) ABSTRACT

A method of removing a diffusion aluminide coating on a component designed for use in a hostile environment, such as superalloy turbine, combustor and augmentor components of a gas turbine engine. The method selectively removes an aluminide coating by stripping aluminum from the coating without causing excessive attack, alloy depletion and gross thinning of the underlying superalloy substrate. Processing steps generally include contacting the coating with a mixture that contains a halogen-containing activator and a metallic powder containing an aluminide-forming metal constituent, such as by pack cementation-type process. The mixture is then heated to a temperature sufficient to vaporize the halogen-containing activator and for a duration sufficient to cause the halogen-containing activator to provide a transfer mechanism for the removal of aluminum from at least a portion of the diffusion aluminide coating, while the metallic powder absorbs the removed aluminum.

20 Claims, No Drawings

METHOD FOR STRIPPING ALUMINUM FROM A DIFFUSION COATING

FIELD OF THE INVENTION

This invention relates to diffusion coatings for components exposed to oxidizing environments, such as the hostile thermal environment of a gas turbine engine. More particularly, this invention is directed to a method for rapidly removing a diffusion aluminide coating from a substrate without damaging the substrate.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high-temperature capabilities have been achieved through the formulation of nickel and cobalt-base superalloys, though without a protective coating components formed from superalloys typically cannot withstand long service exposures if located in certain sections of a gas turbine engine, such as the turbine, combustor and augmentor. One such type of coating is referred to as an environmental coating, i.e., a coating that is resistant to oxidation and hot corrosion. Environmental coatings that have found wide use include diffusion aluminide coatings formed by diffusion processes, such as a pack cementation process.

Diffusion processes generally entail reacting the surface of a component with an aluminum-containing gas composition to form two distinct zones, the outermost of which is an additive layer containing an environmentally-resistant intermetallic represented by MAl, where M is iron, nickel or cobalt, depending on the substrate material. The MAl intermetallic is the result of deposited aluminum and an outward diffusion of iron, nickel or cobalt from the substrate. During high temperature exposure in air, the MAl intermetallic forms a protective aluminum oxide (alumina) scale that inhibits oxidation of the diffusion coating and the underlying substrate. The chemistry of the additive layer can be modified by the presence in the aluminum-containing composition of additional elements, such as chromium, silicon, platinum, rhodium, hafnium, yttrium and zirconium. Beneath the additive layer is a diffusion layer containing various intermetallic and metastable phases that form during the coating reaction as a result of diffusional gradients and changes in elemental solubility in the local region of the substrate. The intermetallics within the additive layer are the products of all alloying elements of the substrate and diffusion coating.

Though significant advances have been made with environmental coating materials and processes for forming such coatings, there is the inevitable requirement to repair these coatings under certain circumstances. For example, removal may be necessitated by erosion or thermal degradation of the diffusion coating, refurbishment of the component on which the coating is formed, or an in-process repair of the diffusion coating or a thermal barrier coating (if present) adhered to the component by the diffusion coating. The current state-of-the-art repair method is to completely remove a diffusion aluminide coating by treatment with an acidic solution capable of interacting with and removing both the additive and diffusion layers. This process relies on lengthy exposures to stripping chemicals, often at elevated temperatures, that cause complete removal of the additive and diffusion layers, and can cause significant attack of the underlying metallic substrate, such as alloy depletion and intergranular or interdendritic attack. Substrate attack is most severe when a component being stripped has regions with different coating thicknesses or has uncoated surface regions, such as the dovetail of a turbine blade. A thicker coating requires longer exposure than does a thinner coating, with the result that the substrate beneath a thinner coating can be exposed to attack by the stripping solution for a significant length of time. For gas turbine blade and vane airfoils, removal of the diffusion layer and substrate attack can produce excessively thinned walls and drastically altered airflow characteristics.

From the above, it can be appreciated that improved methods for rapidly removing a diffusion aluminide coating are desired, particularly an improved method that does not significantly attack the substrate material underlying the coating.

SUMMARY OF THE INVENTION

The present invention generally provides a method of removing a diffusion aluminide coating on a component designed for use in a hostile environment, such as superalloy turbine, combustor and augmentor components of a gas turbine engine. The method is capable of selectively removing an aluminide coating by stripping aluminum from the coating without causing excessive attack, alloy depletion and gross thinning of the underlying superalloy substrate.

The processing steps of this invention generally include contacting the coating with a mixture that contains a halogen-containing activator and a metallic powder containing an aluminide-forming metal. The mixture is then heated to a temperature sufficient to vaporize the halogen-containing activator and for a duration sufficient to cause the halogen-containing activator to remove aluminum from at least a portion of the diffusion aluminide coating without damaging the metallic substrate. The halide-containing activator is preferably aluminum, chromium or ammonium halide, or any combination of these halides.

According to the invention, the halide-containing activator provides a transfer mechanism for aluminum removal from the additive and diffusion layers of the coating, while the metallic powder absorbs the transferred aluminum due to the affinity of the aluminide-forming metal for aluminum. Advantageously, treatment with the mixture is directed to stripping aluminum from the diffusion coating, and is not required to completely remove the diffusion coating as it progressively reacts with the additive and diffusion layers of the coating, as is required by prior art stripping methods. As a result, wall thinning and the likelihood of the substrate being attacked during the treatment are reduced considerably. Therefore, the reliability and service life of components refurbished by the method of this invention are significantly improved over that possible with prior art methods. Furthermore, the time required to strip the coating is significantly reduced, such that the labor, processing and costs required to refurbish a diffusion aluminide coating are also significantly reduced by the process of this invention.

Other objects and advantages of this invention will be better appreciated from the following detailed description.

DETAILED DESCRIPTION OF THE INVENTION

The present invention is generally applicable to metal components that operate within high-temperature environments, and are therefore subjected to oxidation and hot corrosion. Notable examples of such components include the high and low pressure turbine vanes and blades of gas turbine engines. While the advantages of this invention are particularly applicable to nickel-base superalloy components of gas turbine engines, the teachings of this invention are generally applicable to any component on which a diffusion aluminide coating may be used to protect the component from its operating environment.

The method of this invention is directed to the removal of a diffusion aluminide coating on the surface of a component without damaging the underlying substrate of the component. As known in the art, diffusion aluminide coatings are formed by aluminizing processes that produce an additive layer and a diffusion layer between the additive layer and the substrate on which the coating is formed. The additive layer is a monoaluminide layer of the oxidation-resistant MAl intermetallic phase, where M is iron, nickel or cobalt, depending on the substrate material. For example, the intermetallic phase is mainly β(NiAl) if the substrate is a nickel-base superalloy. To promote oxidation resistance, platinum is deposited on the substrate prior to aluminizing, such that the additive layer further includes PtAl intermetallic phases, usually $PtAl_2$ or platinum in solution in the MAl phase. Beneath the additive layer, the diffusion layer contains various intermetallic and metastable phases that are the products of all alloying elements of the substrate and diffusion coating.

During high temperature exposure in air, the MAl intermetallic of the additive layer forms a protective aluminum oxide (alumina) scale that inhibits oxidation of the diffusion coating and the underlying substrate. The thickness of a diffusion aluminide coating on a gas turbine engine component is typically about 50 to about 125 micrometers. Diffusion aluminide coatings can be formed by pack cementation, above-pack and chemical vapor deposition techniques, though it is foreseeable that other techniques could be used.

Diffusion aluminide coatings of interest to this invention are widely used to protect turbine components of gas turbine engines from hot combustion gases and the resulting attack by oxidation, corrosion and erosion. Due to high material and manufacturing costs, coated superalloy components having damaged or flawed diffusion aluminide coatings are repaired on a routine basis. The repair method of this invention entails exposing the diffusion aluminide coating to a powder mixture containing a halogen-containing activator, a metallic powder containing an aluminide-forming metal, and an inert diluent. The activator provides a transfer mechanism for removal of aluminum from the aluminide coating. Suitable activators include aluminum, chromium and ammonium halides, a preferred halide being fluoride, though other halides could be used, such as chlorides, bromides and iodides. Aluminum, chromium and ammonium halide activators can be used alone or in any combination.

The metallic powder is critical to the process of this invention, in that its aluminide-forming metal constituent serves as the aluminum-deficient portion of a diffusion couple. To be suitable for use with this invention, the metallic powder must have a melting temperature that is higher than the elevated temperature to which the powder mixture is heated to remove the aluminide coating. As known in the art, aluminide-forming metals include, among others, nickel, iron, cobalt, iron, platinum and palladium. Generally, nickel is the preferred aluminide-forming metal when treating a nickel-base superalloy substrate, since any diffusion of nickel into the substrate will have a minor effect on substrate properties. Particularly suitable metallic powders contain at least 60 weight percent nickel and less than about 1 weight percent aluminum, an example of which is a nickel alloy powder available from Alloy Surfaces Company, Inc., under the name M7.

Finally, a suitable inert diluent is an aluminum oxide (alumina) powder, though it is foreseeable that other inert compositions could be used. The diluent serves to sufficiently dilute the other constituents to yield a controllable reaction, and further serves to prevent sintering of the nickel-containing particles at the elevated process temperatures. An example of a suitable alumina-coating oxide powder is available from Alloy Surfaces Company, Inc., under the name M1.

The powder mixture of this invention preferably contains about 0.05 to about 5 weight percent of the halogen-containing activator, and about 5 to about 80 weight percent of a nickel-base powder, with the balance being essentially the inert diluent. A particularly preferred composition for the powder mixture is about 0.2 weight percent ammonium fluoride, and about 20 weight percent of the nickel-base powder, with the balance being aluminum oxide powder.

A preferred method for removing a diffusion aluminide coating with the above-described powder mixture of this invention is to place the coated component in the powder mixture such that the aluminide coating directly contacts the powder mixture. Any uncoated regions of the component, such as the dovetail and shank of a turbine blade, are preferably masked or otherwise isolated from the activator. The component and powder are then heated within an inert or reducing atmosphere, preferably hydrogen, to a temperature of at least 1700° F. (about 925° C.), preferably about 1010° C. to about 1075° C., for a duration sufficient to enable the activator to remove aluminum from the diffusion coating without depleting the non-aluminum constituents of the coating and without attacking the substrate. In practice, a suitable duration for this process is about one to about ten hours. While the process of this invention could foreseeably be carried out with a variety of equipment, a preferred apparatus is basically that used for pack cementation processes of the prior art, in which the component is placed in an enclosure and the mixture is packed around the component to assure adequate contact between the mixture and the aluminide coating.

According to this invention, the above-described process does not attack or deplete the substrate. Instead, the process selectively removes aluminum from the additive and diffusion layers of the diffusion coating. If so desired, the additive layer of the diffusion coating may be removed prior to the treatment of this invention by chemical stripping (e.g., nitric/phosphoric acid treatment) or mechanical stripping (abrasive blasting) techniques, such that aluminum removal is from the remaining diffusion layer only. In this manner, selective leaching of aluminum from the remaining diffusion layer is promoted, while constituents of the additive layer, such as platinum of a platinum aluminide coating, can be more readily recovered. Once aluminum has been extracted from the diffusion layer, the component may be further prepared for deposition of a new diffusion aluminide coating by undergoing light grit blasting and/or chemical cleaning.

During testing to evaluate the invention, diffusion aluminide coatings were treated using powder mixtures containing about 20 to 60 weight percent of a nickel-base powder containing at least 60 weight percent nickel, about 0.2 to 0.4 weight percent $NH_4F$, the balance alumina powder, over durations of three to six hours and at temperatures of about 1850° F. (about 1010° C.) to about 1950° F. (1065° C.) . After the treatments, aluminum remaining in the diffusion coatings ranged from zero to about 2.34 weight percent, with the result that the coatings were sufficiently stripped of aluminum to permit the formation of a new aluminide coating.

While our invention has been described in terms of a preferred embodiment, it is apparent that other forms could be adopted by one skilled in the art. For example, this invention is also applicable to a diffusion coating used as a bond coat for a thermal-insulating layer, as is often the case for high-temperature components of a gas turbine engine. Accordingly, the scope of our invention is to be limited only by the following claims.

What is claimed is:

1. A method for removing a diffusion aluminide coating on a metallic substrate, the method comprising the steps of:

preparing a mixture comprising a halogen-containing activator and a metallic powder containing an aluminide-forming metal and less than 1 weight percent aluminum;

contacting the diffusion aluminide coating with the mixture; and heating the mixture in an inert or reducing atmosphere to a temperature sufficient to vaporize the halogen-containing activator and for a duration sufficient to cause the halogen-containing activator to remove aluminum from at least a portion of the diffusion aluminide coating without removing aluminum from the metallic substrate.

2. A method as recited in claim 1, wherein the diffusion aluminide coating comprises an additive layer and a diffusion layer between the additive layer and the metallic substrate.

3. A method as recited in claim 2, wherein the heating step causes removal of aluminum from the additive and diffusion layers.

4. A method as recited in claim 2, further comprising the step of removing the additive layer prior to the contacting step, such that the heating step entails removing aluminum from only the diffusion layer.

5. A method as recited in claim 2, wherein the step of removing the additive layer is a stripping operation chosen from the group consisting of chemical and mechanical stripping techniques.

6. A method as recited in claim 1, wherein the mixture consists essentially of at least about 0.05 weight percent of the halogen-containing activator, about 5 to about 80 weight percent of the metallic powder, with the balance being an inert diluent.

7. A method as recited in claim 1, wherein the contacting and heating steps constitute a pack diffusion process.

8. A method as recited in claim 1, wherein the metallic powder comprises, by weight, at least about 60% nickel and less than 1% aluminum.

9. A method as recited in claim 1, wherein the halide-containing activator is one or more halides chosen from the group consisting of aluminum, chromium and ammonium halides.

10. A method as recited in claim 1, wherein the metallic substrate is a component of a gas turbine engine.

11. A method for removing a diffusion aluminide coating on a nickel-base superalloy substrate of a gas turbine engine component, the diffusion aluminide coating comprising an additive layer and a diffusion layer between the additive layer and the substrate, the method comprising the steps of:

preparing a mixture comprising a halogen-containing activator, a metallic powder containing nickel and less than 1 weight percent aluminum, and an inert diluent;

packing the component in the mixture such that the mixture contacts the diffusion aluminide coating; and heating the mixture and component to a temperature of at least 925° C. to vaporize the halogen-containing activator and for a duration sufficient to cause the halogen-containing activator to remove aluminum from at least a portion of the diffusion aluminide coating without damaging or removing aluminum from the substrate.

12. A method as recited in claim 11, wherein the heating step causes removal of aluminum from the additive and diffusion layers.

13. A method as recited in claim 11, further comprising the step of removing the additive layer prior to the packing step, such that the heating step entails removing aluminum from only the diffusion layer.

14. A method as recited in claim 11, wherein the step of removing the additive layer is a stripping operation chosen from the group consisting of chemical and mechanical stripping techniques.

15. A method as recited in claim 11, wherein the mixture consists essentially of about 0.05 to about 5 weight percent of the halogen-containing activator, about 5 to about 80 weight percent of the metallic powder, with the balance being the inert diluent.

16. A method as recited in claim 11, wherein the inert diluent comprises an alumina powder.

17. A method as recited in claim 11, wherein the metallic powder comprises, by weight, at least about 60% nickel and less than 1% aluminum.

18. A method as recited in claim 11, wherein the halide-containing activator is one or more halides chosen from the group consisting of aluminum, chromium and ammonium halides.

19. A method as recited in claim 11, wherein the diffusion aluminide coating is a platinum aluminide diffusion coating.

20. A method for removing a diffusion aluminide coating on a nickel-base superalloy substrate of a gas turbine engine component, the diffusion aluminide coating comprising an additive layer and a diffusion layer between the additive layer and the substrate, the method comprising the steps of:

preparing a mixture consisting essentially of about 0.05 to about 5 weight percent of a halogen-containing activator powder, about 5 to about 80 weight percent of a nickel-containing metallic powder, the balance being an inert diluent powder, the halogen-containing activator powder being chosen from the group consisting of aluminum, chromium and ammonium halides, the nickel-containing metallic powder comprising, by weight, at least about 60% nickel and less than 1% aluminum;

packing the component in the mixture such that the mixture contacts the diffusion aluminide coating; and heating the mixture and component to a temperature of at least 925° C. to vaporize the halogen-containing activator and for a duration sufficient to cause the halogen-containing activator to remove aluminum from the additive and diffusion layers of the diffusion aluminide coating without damaging or removing aluminum from the substrate.

* * * * *